US006839536B2

(12) United States Patent
Do

(10) Patent No.: US 6,839,536 B2
(45) Date of Patent: Jan. 4, 2005

(54) TONER LAYER REGULATING MEMBER AND DEVELOPING DEVICE USING THE SAME

(75) Inventor: Ki-jae Do, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/211,528

(22) Filed: Aug. 5, 2002

(65) Prior Publication Data

US 2003/0108364 A1 Jun. 12, 2003

(30) Foreign Application Priority Data

Dec. 10, 2001 (KR) ..... 2001-77796

(51) Int. Cl.[7] ..... G03G 15/08
(52) U.S. Cl. ..... 399/284
(58) Field of Search ..... 399/222, 265, 399/274, 284

(56) References Cited

U.S. PATENT DOCUMENTS 4,814,818 A * 3/1989 Fuma et al. ..... 399/274
5,191,170 A * 3/1993 Yoshida et al. ..... 399/274
5,257,075 A * 10/1993 Ohki ..... 399/284 X
5,733,235 A * 3/1998 Waku et al. ..... 492/25
5,863,329 A * 1/1999 Yamanouchi ..... 399/274 X
5,907,758 A * 5/1999 Tanaka et al. ..... 399/303
6,064,463 A * 5/2000 Yamada et al. ..... 399/284 X
6,078,770 A * 6/2000 Watabe et al. ..... 399/284
6,243,552 B1 * 6/2001 Murata ..... 399/176
6,606,474 B2 * 8/2003 Sirejacob ..... 399/274

* cited by examiner

*Primary Examiner*—Sandra Brase
(74) *Attorney, Agent, or Firm*—Staas & Halsey LLP

(57) ABSTRACT

A toner layer regulating member and a developing device using the toner layer regulating member. The toner layer regulating member forms a uniform toner layer on a toner transfer unit, electrically charges a toner by friction, and includes a polyolefin-based elastic rubber member which contacts the outer circumference surface of the toner transfer unit and whose surface is ultraviolet-treated. Thus, a uniform toner layer can be formed on the toner transfer unit and the toner is electrically charged by friction. As a result, a high quality image having no defects can be provided.

19 Claims, 7 Drawing Sheets

TONER LAYER REGULATING MEMBER AND DEVELOPING DEVICE USING THE SAME

CROSS-REFERENCE TO RELATED APPLICATIONS

This application claims the benefit of Korean Application No. 2001-77796, filed Dec. 10, 2001, in the Korean Industrial Property Office, the disclosure of which is incorporated herein by reference.

BACKGROUND OF THE INVENTION

1. Field of the Invention

The present invention relates to an electrophotographic image forming apparatus, such as a laser printer, a facsimile machine, or a copier, and more particularly, to a toner layer regulating member to form a uniform toner layer on a toner transfer unit and to electrically charge a toner by friction, and a developing device using the same.

2. Description of the Related Art

In general, an electrophotographic image forming apparatus forms a latent electrostatic image on a photosensitive surface and develops the latent electrostatic image into a visible toner image.

FIG. 1 is a schematic view of an electrophotographic image forming apparatus using a non-magnetic one-component toner. Referring to FIG. 1, the electrophotographic image forming apparatus includes a photosensitive body 1, a charging roller 2, an exposing portion 3, a toner transfer unit 5, and a transfer roller 9. Here, the photosensitive body 1 rotates in a predetermined direction. The charging roller 2 frictionally charges the surface of the photosensitive body 1 with a predetermined potential. The exposing portion 3 radiates light onto the photosensitive body 1 in accordance with a computer signal, to form a latent image thereon. The toner transfer unit 5 develops the exposing portion 3 with the latent image with a toner 8 stored in a toner container 4. The transfer roller 9 transfers the developed toner image to a paper 13. A supply roller 6 to attach the toner 8 to the toner transfer unit 5 and a toner layer regulating member 7 to form a toner layer with a predetermined thickness on the toner transfer unit 5 are installed outside the toner transfer unit 5.

In the above-described configuration, the charging roller 2 charges the photosensitive body 1 with electricity and then an electrostatic latent image is formed on the surface of the photosensitive body 1 by the exposing portion 3. The toner 8, which is non-magnetic, is supplied into the toner transfer unit 5 by the supply roller 6 and is made into a thin film having a uniform thickness by the toner layer regulating member 7. Here, the toner 8 is charged with high triboelectricity by the friction between the toner transfer unit 5 and the toner layer regulating member 7. The latent electrostatic image formed on the surface of the photosensitive body 1 is developed by the toner 8, which has passed through the toner layer regulating member 7, transferred to the paper 13 by the transfer roller 9, and fused by a fusing roller 12. The toner 8 remaining on the photosensitive body 1 is cleaned by a cleaner 10.

FIG. 2 shows a toner layer regulating member used in the above-described image forming apparatus, which is disclosed in U.S. Pat. No. 5,768,670. Referring to FIG. 2, a toner layer regulating member 7 uses a urethane rubber of rubber hardness 65 (according to a Wallace hardness meter) as an elastic layer 7*b*. Both sides of the elastic layer 7*b* are coated with a thermoplastic nylon resin to form an electrifying layer 7*c*. One side of the electrifying layer 7*c* is combined with a support member 7*a*, which is formed of phosphor bronze having a thickness of 150 $\mu$m. The electrifying layer 7*c* is made by dip-coating the elastic layer 7*b* with a thermoplastic nylon resin to electrify the toner by friction, and adhesion to the support member 7*a*. The electrifying layer 7*c* is adhered to the support member 7*a* by heat.

A method of manufacturing the toner layer regulating member will now be described. First, methyl alcohol 20% solution of AMIRUN CM4000 (produced by Toray Co., Ltd.) is applied to opposite surfaces of the urethane rubber by the dip coating method, and is air-dried at 80°. Here, the film thickness of the nylon is 20 $\mu$m, usually enabling film formation to be done uniformly. The rubber having the AMIRUN CM4000 film is cut into a predetermined size and set on a bed with a support member above and heated at 160° at a pressure of 0.5 kg/cm$^2$ for 30 sec. Then, a thermoplastic resin is adhered on the surfaces of the rubber and the support member 7*a*.

This method of manufacturing the conventional toner layer regulating member is very complicated. In particular, a thickness deviation occurs during the dip coating, and thus it is difficult to obtain a uniform toner layer. Also, weak adhesion to a base material such as the support member 7*a* causes the stripping of the layer from the surface of the base material. In this case, foreign substances are mixed during the dip coating, and thus it is difficult to form a uniform toner layer on the toner transfer unit 5.

SUMMARY OF THE INVENTION

Accordingly, it is an object of the present invention to provide an improved toner layer regulating member which can form a uniform toner layer on the toner transfer unit, and a simplified manufacturing method, and a developing device using the same.

Additional objects and advantages of the invention will be set forth in part in the description which follows and, in part, will be obvious from the description, or may be learned by practice of the invention.

The above and other objects of the invention are achieved by providing a toner layer regulating member which is installed on a portion of an outer circumference surface of a toner transfer unit, forms a uniform toner layer on the toner transfer, and electrically charges a toner by friction, the toner layer regulating member including a polyolefin-based elastic rubber member to contact the outer circumference surface of the toner transfer unit and having a surface that is ultraviolet-treated.

According to an aspect of the present invention, the polyolefin-based elastic rubber member is formed of a nitrile-butadiene rubber-based elastic rubber or a styrene-butadiene rubber-based elastic rubber.

Furthermore, the toner layer regulating member includes a support plate to support the elastic rubber member so that the elastic rubber member contacts the outer circumference surface of the toner transfer unit.

The above and other objects and advantages of the invention are also achieved by providing a developing device including a photosensitive body; a toner transfer unit to transfer a toner to the photosensitive body and to develop a latent image formed on the photosensitive body; a toner container to contain the toner; a supply roller to supply the toner contained in the toner container to the toner transfer unit; and a toner layer regulating member installed on a portion of an outer circumference surface of the toner transfer unit to form a uniform toner layer on the toner transfer unit, and to electrically charge the toner by friction, wherein the toner layer regulating member includes a polyolefin-based elastic rubber member to contact the outer circumference surface of the toner transfer unit and having surface that is ultraviolet-treated.

According to an aspect of the present invention, the toner layer regulating member includes a polyolefin-based elastic rubber member which contacts the outer circumference surface of the toner transfer unit and whose surface is ultraviolet-treated.

The toner layer regulating member further includes a support plate to support the elastic rubber member so that the elastic rubber member contacts the outer circumference surface of the toner transfer.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
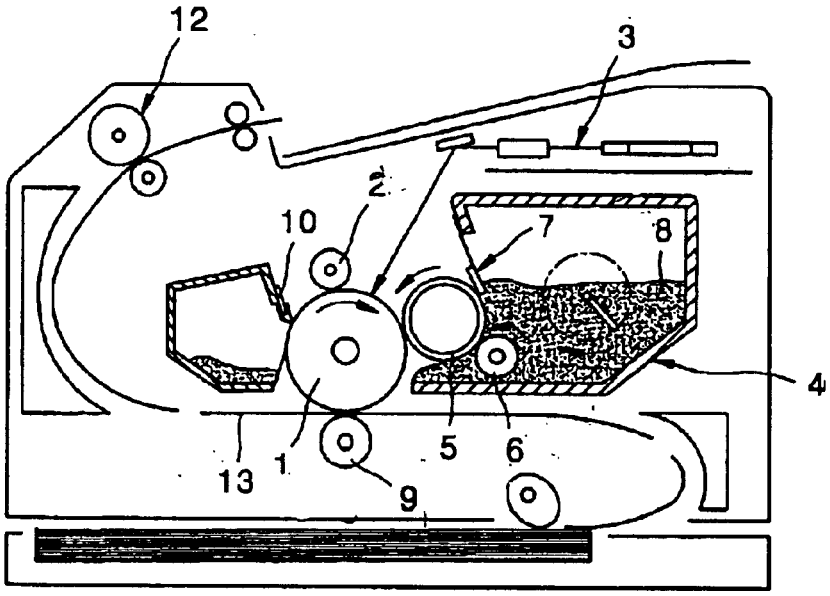
FIG. 1 (PRIOR ART)
FIG. 1 is a schematic view of a conventional electrophotographic image forming apparatus.
Figure 2:
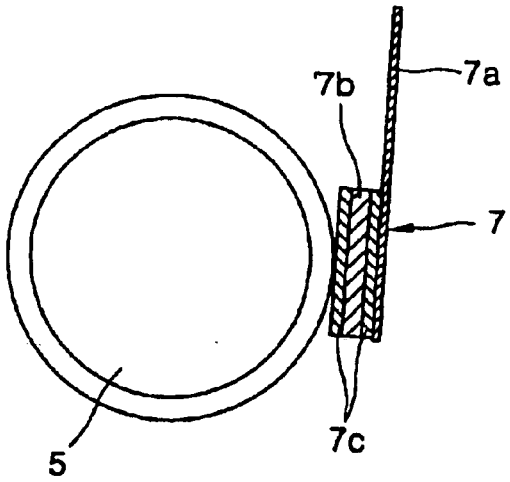
FIG. 2 (PRIOR ART)
FIG. 2 is a cross-sectional view of the conventional toner layer regulating member of FIG. 1.

Reference will now be made in detail to the present preferred embodiments of the present invention, examples of which are illustrated in the accompanying drawings, wherein like reference numerals refer to like elements throughout.

Figure 3A:
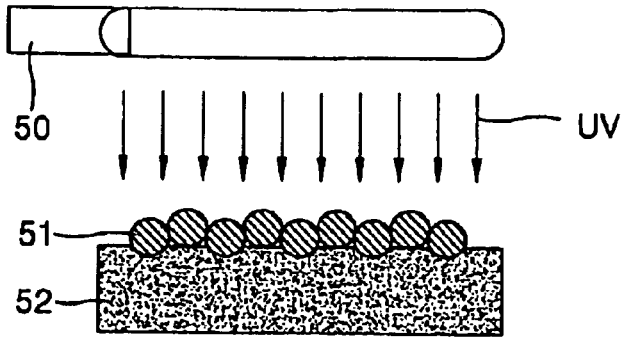
FIGS. 3A through 3D are cross-sectional views explaining a process of radiating ultraviolet (UV) onto the surface of a rubber member according to the present invention.
Figure 3B:
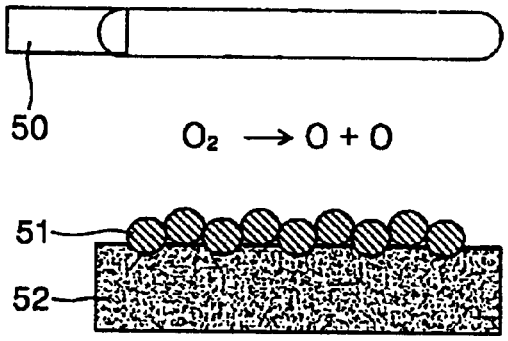
Figure 3C:
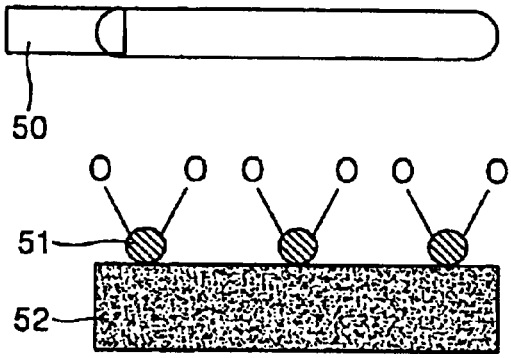
Figure 3D:
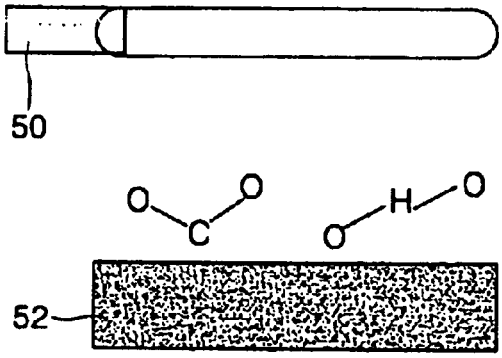

FIGS. 3A through 3D are cross-sectional views explaining a process of radiating ultraviolet (UV) onto the surface of a rubber member used for a toner layer regulating member according to the present invention. As shown in FIG. 3A, when a UV lamp 50 radiates UV in the air, an oxygen molecule $O_2$ in the air is decomposed by UV energy having a wavelength of 184 nm and a main chain (or backbone) and a side chain of organic molecules 51 on the surface of a rubber member 52 are cut. Next, as shown in FIG. 3B, $O_2$ is decomposed into active monomolecules O, which are combined with $O_2$ remaining, in the air into $O_3$. As shown in FIG. 3C, $O_3$ absorbs UV energy having a wavelength of 253.7 nm and is decomposed into $O_2$ and O to form active monomolecules O. Here, the active monomolecules O stick to the organic molecules 51 whose chain is cut to be activated. As a result, the organic molecules 51 are oxidized. As shown in FIG. 3D, the oxidized organic molecules are changed into $CO_2$ and $H_2O$, having volatility, and removed from the surface of the rubber member 52.

As described above, when UV is radiated onto the surface of the rubber member 52, the property of the surface of the rubber member 52 is changed. Thus, dust sticking on the rubber member 52 or hypomolecules coming from the inside of the rubber member onto the surface is removed. As a result, the coefficient of friction is reduced on the surface of the rubber member 52 onto which UV is radiated.

Figure 4:
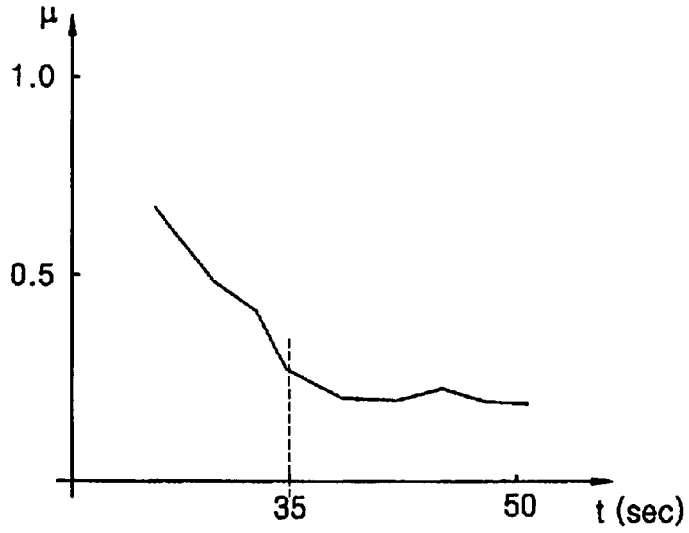
FIG. 4 is a graph showing changes in the coefficient of friction based on the time required for radiating UV.
Figure 5:
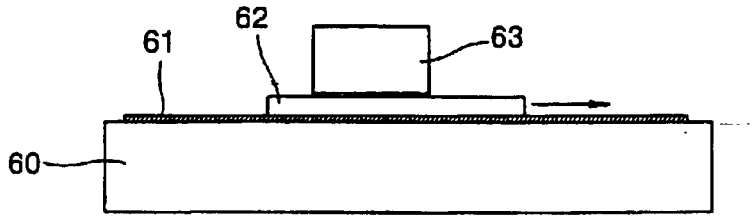
FIG. 5 is a cross-sectional view explaining a test for measuring the coefficient of friction of FIG. 4.

FIG. 4 is a graph showing changes in the coefficient of friction ($\mu$) on the surface of the rubber member 52 based on the time (t) required for radiating UV onto the surface of the rubber member 52 using a UV lamp of 2700–3000W. To measure the coefficient of friction ($\mu$), as shown in FIG. 5, an overhead projector (OHP) film 61 is fixed on a flat plate 60. Also, a rubber member 62 is used as a measurement member onto which UV is radiated and is placed on the OHP film 61. A scale weight 63 of 73 g is placed on the rubber member 62. A push-pull gauge pulls the rubber member 62 at a speed of 50 mm/min in a direction (indicated by the arrow) to measure the coefficient of friction ($\mu$). As a result, the coefficient of friction ($\mu$) on the surface of the rubber member 62 is gradually reduced as shown in FIG. 4 as the time (t) required for radiating UV gets longer.

A toner layer regulating member according to the present invention uses the above result to form a uniform toner layer on a toner transfer unit and has an elastic rubber member having a surface in contact with the outer circumference surface of the toner transfer unit that is ultraviolet-treated to charge a toner with triboelectricity. Here, the elastic rubber member is a polyolefin-based elastic rubber such as a nitrile rubber or an acryl rubber. A rubber hardness is within a range of 10–90°, which is measured by an Asca A hardness meter. The polyolefin-based elastic rubber is a nitrile-butadiene rubber-based or styrene-butadiene rubber-based elastic rubber.

Figure 6A:
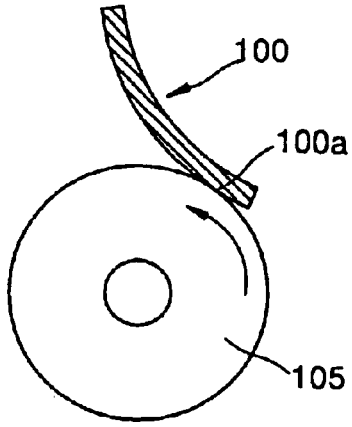
FIGS. 6A through 6D are cross-sectional views of a toner layer regulating member according to the present invention.
Figure 6B:
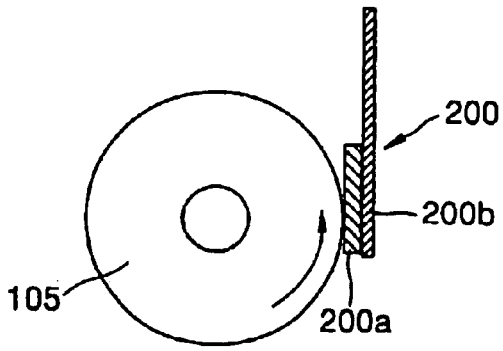
Figure 6C:
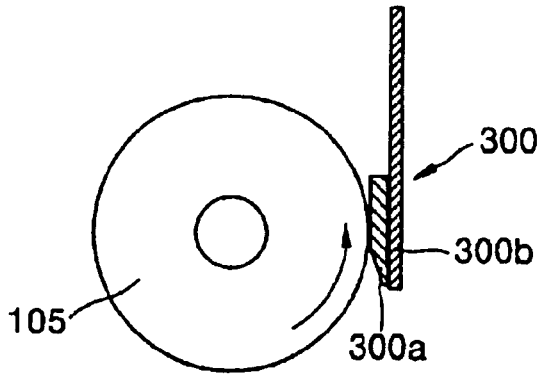
Figure 6D:
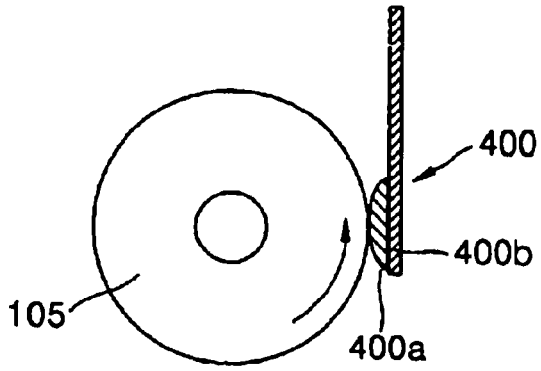

As described above, if the surface of the elastic rubber member which contacts the outer circumference surface of the toner transfer is UV-treated, the coefficient of friction ($\mu$) on the surface of the elastic rubber member is reduced. As a result, the toner is prevented from being fused and fixed and a toner layer is maintained to be uniform on the toner transfer unit. FIGS. 6A through 6D are cross-sectional views of toner layer regulating members according to embodiments of the present invention in which various elastic rubber members are shown. In FIG. 6A, a toner layer regulating member 100 includes an elastic rubber member 100*a*. In FIGS. 6B through 6D, toner layer regulating members 200, 300, and 400 further include support plates 200*b*, 300*b*, and 400*b* to support elastic rubber members 200*a*, 300*a*, and 400*a*, respectively, so that the elastic rubber members 200*a*, 300*a*, and 400*a* contact the outer circumference surface of a toner transfer unit 105. Here, the properties of the surfaces of the elastic rubber members 100*a*, 200*a*, 300*a*, and 400*a* which contact the outer circumference surface of the toner transfer unit 105 are changed due to the radiation of UV, as described previously.

Figure 7:
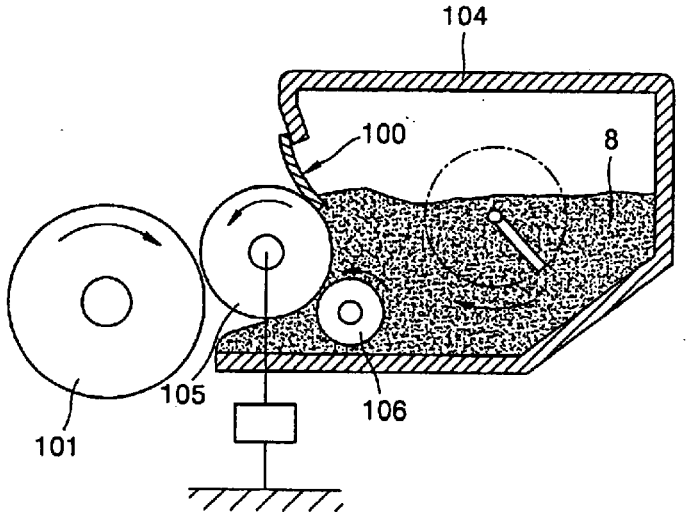
FIG. 7 is a view of a developing device using a toner layer regulating member according to the present invention.

FIG. 7 is a schematic view of a developing device using a toner layer regulating member according to the present invention. Referring to FIG. 7, the developing device includes a cylindrical toner transfer unit 105, a supply roller 106, and a toner layer regulating member 100. The cylindrical toner transfer unit 105 transfers a toner 8 to a photosensitive body 101 and develops a latent image formed on the photosensitive body 101. The supply roller 106 is installed in a toner container 104, which contains the toner 8 and supplies the toner 8 to the toner transfer unit 105. The toner layer regulating member 100 is installed on a portion of the outer circumference surface of the toner transfer unit 105, forms a uniform toner layer on the toner transfer unit 105, and charges the toner 8 with triboelectricity. Here, the toner layer regulating member 100, as shown in FIG. 6A, includes a polyolefin-based elastic rubber member which contacts the outer circumference surface of the toner transfer unit 105, which is UV-treated. The developing device having the toner layer regulating member 100 shown in FIG. 6A has been described. However, the toner layer regulating members 200, 300, and 400 shown in FIGS. 6B through 6D may also be applied to the developing device. In this configuration, a uniform toner layer is formed on the toner transfer unit 105 and the toner 8 is charged with triboelectricity by the toner layer regulating member 100, which contacts the outer circumference surface of the toner transfer unit 105. The toner 8 develops the latent image formed on the photosensitive body 101.

Table 1 shows results of the toner layer on the toner transfer unit and the quality of an output image which are measured using the developing device according to the present invention.

TABLE 1

| Coefficient of friction | Toner amount per unit area ($mg/cm^2$) | Charge amount per unit mass ($\mu C/g$) | Image density: Initial Stage | Image density: After printing 3000 sheets | Uniformity of image density |
|---|---|---|---|---|---|
| 0.60 | 0.30 | −18.0 | 0.80 | 1.00 | Poor |
| 0.35 | 0.55 | −14.0 | 1.25 | 1.10 | Normal |
| 0.20 | 0.60 | −12.5 | 1.35 | 1.38 | Good |
| 0.15 | 0.65 | −12.0 | 1.40 | 1.38 | Good |

As seen in Table 1, if UV is radiated onto the surface of the toner layer regulating member which contacts the outer circumference surface of the toner transfer unit to reduce the coefficient of friction ($\mu$), toner amount per unit area, i.e., a toner layer, and charge amount per unit mass can be controlled to maintain a high quality image.

As described above, according to the present invention, UV is radiated onto the surface of a toner layer regulating member which contacts the outer circumference surface of a toner transfer unit to control the coefficient of friction on the surface of the toner layer regulating member. Thus, a uniform toner layer can be formed on the toner transfer unit and the toner can uniformly be charged with triboelectricity. As a result, a high quality image having no defects can be provided. Also, a method of manufacturing the toner layer regulating member is simplified, and thus costs for manufacturing the toner layer regulating member can be reduced.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A toner layer regulating member which is installed on a portion of an outer circumference surface of a toner transfer unit, forms a uniform toner layer on the toner transfer unit, and electrically charges a toner by friction, the toner layer regulating member comprising:

a polyolefin-based elastic rubber member to contact the outer circumference surface of the toner transfer unit and having a surface that is ultraviolet-treated to maintain the uniform toner layer.

2. The toner layer regulating member of claim 1, wherein the polyolefin-based elastic rubber member comprises a nitrile-butadiene rubber-based elastic rubber.

3. The toner layer regulating member of claim 1, wherein the polyolefin-based rubber member comprises a styrene-butadiene rubber-based elastic rubber.

4. The toner layer regulating member of claim 1, further comprising a support plate to support the elastic rubber member, wherein the elastic rubber member contacts the outer circumference surface of the toner transfer unit.

5. A developing device comprising:

a photosensitive body;

a toner transfer unit to transfer a toner to the photosensitive body and to develop a latent image formed on the photosensitive body;

a toner container to contain the toner;

a supply roller to supply the toner contained in the toner container to the toner transfer unit; and a toner layer regulating member installed on a portion of an outer circumference surface of the toner transfer unit to form a uniform toner layer on the toner transfer unit, an to electrically charge the toner by friction, wherein the toner layer regulating member includes a polyolefin-based elastic rubber member to contact the outer circumference surface of the toner transfer unit and having a surface that is ultraviolet-treated to maintain the uniform toner layer.

6. The developing device of claim 5, wherein the toner layer regulating member further comprises a support plate to support the elastic rubber member, wherein the elastic rubber member contacts the outer circumference surface of the toner transfer unit.

7. A developing device comprising:

a photosensitive body;

a toner transfer unit to transfer a toner to the photosensitive body, the toner transfer unit having an outer circumference surface; and a toner layer regulating member installed on the outer circumference surface to form a uniform toner layer on the toner transfer unit, the toner layer regulating member comprising a rubber member to contact the outer circumference surface of the toner transfer unit, the rubber member having a surface that is ultraviolet-treated to maintain the uniform toner layer.

8. The developing device of claim 7, wherein the rubber member is a polyolefin-based elastic rubber member.

9. The developing device of claim 8, wherein the tone layer regulating member further comprises a support plate to support the rubber member.

10. The developing device of claim 9, wherein the rubber member has a semi-circular shape.

11. The developing device of claim 9, wherein the rubber member has a tapered end portion.

12. A toner layer regulating member, installed on an outer circumference surface of a toner transfer unit of a developing device, the toner layer regulating member comprising:

a rubber member to contact the outer circumference surface of the toner transfer unit, the rubber member having a surface that is ultraviolet-treated to maintain a uniform toner layer on the toner transfer unit.

13. The toner layer regulating member of claim 12, wherein the rubber member is a polyolefin-based elastic rubber member.

14. The toner layer regulating member of claim 13, wherein the rubber member has a hardness within a range of 10–90°.

15. A method of making a developing device, the method comprising:

radiating ultraviolet energy onto a rubber member to reduce a coefficient of friction of the rubber member to maintain a uniform toner layer on a toner transfer unit; and contacting the rubber member with the toner transfer unit.

16. The method of claim 15, wherein a toner is transferred from the toner transfer unit to a photosensitive body, and a uniform toner layer is formed on the toner transfer unit with the rubber member.

17. The method of claim 15, further comprising:

supporting the rubber member with a support plate.

18. The developing device of claim 15, wherein the rubber member has a semi-circular shape.

19. The developing device of claim 15, wherein the rubber member has a tapered end portion.

* * * * *

UNITED STATES PATENT AND TRADEMARK OFFICE

CERTIFICATE OF CORRECTION

PATENT NO. : 6,839,536 B2
DATED : January 4, 2005
INVENTOR(S) : Ki-Jae Do

It is certified that error appears in the above-identified patent and that said Letters Patent is hereby corrected as shown below:

Column 6,
Line 22, please change "an" to -- and --.
Line 48, please change "tone" to -- toner --.

Signed and Sealed this

Thirty-first Day of May, 2005

JON W. DUDAS
*Director of the United States Patent and Trademark Office*